United States Patent [19]

Teraoka

[11] Patent Number: 4,491,736

[45] Date of Patent: Jan. 1, 1985

[54] RADIATION IMAGE STORAGE PANEL

[75] Inventor: Masanori Teraoka, Kanagawa, Japan

[73] Assignee: Fuji Photo Film Co., Ltd., Kanagawa, Japan

[21] Appl. No.: 326,642

[22] Filed: Dec. 2, 1981

[30] Foreign Application Priority Data

Dec. 5, 1980 [JP] Japan ..... 55-171545

[51] Int. Cl.[3] ..... G03C 5/16

[52] U.S. Cl. ..... 250/484.1; 250/327.2

[58] Field of Search ..... 250/484.1, 327.2

[56] References Cited

U.S. PATENT DOCUMENTS 4,380,702 4/1983 Takahashi et al. ..... 250/484.1 X 4,394,581 7/1983 Takahashi et al. ..... 250/484.1

*Primary Examiner*—Alfred E. Smith

*Assistant Examiner*—Jack I. Berman

*Attorney, Agent, or Firm*—Sughrue, Mion, Zinn, Macpeak and Seas

[57] ABSTRACT

A radiation image storage panel having a fluorescent layer which comprises a binder and a stimulable phosphor dispersed therein. The panel is colored with an organic colorant which does not exhibit light emission of longer wavelength than that of the stimulating rays for the stimulable phosphor when exposed to the stimulating rays. The panel is colored so that the mean reflectance of the panel in the wavelength region of the stimulating rays is lower than the mean reflectance of the panel in the wavelength region of the light emitted by the stimulable phosphor upon stimulation thereof. The panel provides an image of high sharpness and contrast.

16 Claims, 3 Drawing Figures

RADIATION IMAGE STORAGE PANEL

BACKGROUND OF THE INVENTION

1. Field of the Invention

This invention relates to a radiation image storage panel using a stimulable phosphor, and more particularly to a radiation image storage panel for recording and reproducing a radiation image using a stimulable phosphor which stores radiation energy and emits light upon stimulation thereof.

2. Description of the Prior Art

As is well known in the art, a photographic method using a silver salt such as radiography in which an X-ray film having an emulsion layer comprising a silver salt is used in combination with an intensifying screen has generally been employed to obtain a radiation image. Recently, because of problems such as the shortage of silver resources, a method of obtaining a radiation image without using a silver salt has been desired.

An example of such a method is disclosed in U.S. Pat. No. 3,859,527. In the method of the patent, there is used a radiation image storage panel comprising a stimulable phosphor which emits light when stimulated by an electromagnetic wave selected from among visible light and infrared rays after exposure to a radiation (The term "radiation" as used herein means electromagnetic wave or corpuscular radiation such as X-rays, $\alpha$-rays, $\beta$-rays, $\gamma$-rays, high-energy neutron rays, cathode rays, vacuum ultraviolet rays, ultraviolet rays, or the like.). The method comprises the steps of (i) causing the stimulable phosphor of the panel to absorb a radiation passing through an object, (ii) scanning the panel with an electromagnetic wave such as visible light or infrared rays (hereinafter referred to as "stimulating rays") to sequentially release the radiation energy stored in the panel as light emission, and (iii) electrically converting the emitted light into an image.

In this connection, it is well known in the art that in conventional radiography in which an intensifying screen is used in combination with an X-ray film, the sharpness of the image obtained depends upon the degree of spread of the spontaneous light emitted by the phosphor in the intensifying screen. In contrast to this, in the above-mentioned method for recording and reproducing a radiation image utilizing the stimulability of a stimulable phosphor, the sharpness of the image obtained does not depend upon the degree of spread of the light emitted by the stimulable phosphor in the panel, but depends upon the degree of spread of the stimulating rays in the panel. The reason for this can be explained as follows. In the above-mentioned method for recording and reproducing a radiation image, the radiation image stored in the panel is taken out of the panel sequentially as mentioned above. Therefore, all of the light emission caused by the stimulating rays for a certain period (ti) is desirably detected as the output of a certain picture element (xi, yi) on the panel which is exposed to the stimulating rays during the period (ti). Where the stimulating rays spread in the panel due to scattering or the like and stimulate the phosphor surrounding the picture element (xi, yi) in addition to the picture element (xi, yi), the output for an area broader than the picture element (xi, yi) is detected as the output of the picture element (xi, yi). Accordingly, if the light emission caused by the stimulating rays during the period (ti) is only that emitted by the picture element (xi, yi) which has been exactly exposed to the stimulating rays during the period (ti), the emitted light does not affect the sharpness of the image obtained no matter how the emitted light spreads in the panel.

The radiation image storage panel employed in the above-mentioned method for recording and reproducing a radiation image has at least a fluorescent layer comprising a proper binder and a stimulable phosphor dispersed therein. Although the fluorescent layer itself can be a radiation image storage panel when the fluorescent layer is self-supporting, the fluorescent layer is generally provided on a proper substrate to form a radiation image storage panel. Further, a protective layer for physically and chemically protecting the fluorescent layer is usually provided on the surface of the fluorescent layer to be subject to exposure. Furthermore, a primer layer is sometimes provided between the fluorescent layer and the substrate to closely bond the fluorescent layer to the substrate. In the conventional radiation image storage panel having such a structure, the stimulating rays broadly spread in the panel due to irradiation in the fluorescent layer, halation in the protective layer, the primer layer or the substrate, or the like. Therefore, an image of high sharpness cannot be obtained by the conventional radiation image storage panel.

As a radiation image storage panel in which the above-mentioned defect in the conventional radiation image storage panel is reduced, a radiation image storage panel colored with a colorant was invented and an application for patent on the panel was filed (see U.S. Pat. No. 4,394,581). The radiation image storage panel disclosed in the application has a fluorescent layer comprising a binder and a stimulable phosphor dispersed therein and is characterized by being colored with a colorant so that the mean reflectance of the panel in the wavelength region of the stimulating rays for the stimulable phosphor is lower than the mean reflectance of the panel in the wavelength region of the light emitted by the stimulable phosphor upon stimulation thereof. In the radiation image storage panel, the spread of the stimulating rays in the panel can be controlled by the absorption of the stimulating rays by the colorant and as a result, an image having markedly improved sharpness can be obtained.

It is described in the above-mentioned U.S. Pat. No. 4,394,581 that either an organic colorant or an inorganic colorant can be employed as the colorant. Actually, in the case wherein either an organic colorant or an inorganic colorant is employed, a radiation image storage panel which provides an image of high sharpness can be obtained if the colorant employed absorbs the stimulating rays. However, as a result of subsequent studies regarding the radiation image storage panel colored with a colorant, it was found that other image characteristics of the panel such as granularity and contrast varied considerably depending upon the colorant employed in the panel.

In the colored radiation image storage panel disclosed in the above-mentioned U.S. Pat. No. 4,394,581 the panel colored with an organic colorant generally provides an image of better granularity than the panel colored with an inorganic colorant. This is because the particle size of an organic colorant is generally very small in comparison with the particle size of an inorganic colorant. Therefore, from the viewpoint of the granularity of the radiation image storage panel, it is preferable to employ an organic colorant as the colorant of the panel. However, when the organic colorants described in the above-mentioned U.S. Pat. No. 4,394,581 are employed as the colorant, only a radiation image storage panel which provides an image of low contrast can be obtained. This is because all of the organic colorants described in the above-mentioned U.S. Pat. No. 4,394,581 exhibit light emission of longer wavelength (generally in the red to infrared region) than that of the stimulating rays (generally in the wavelength region of 500 to 800 nm depending upon the stimulable phosphor employed) when exposed to the stimulating rays, and at least a part of the light emission is reproduced as noise observed throughout the radiation image storage panel. In Example 1 of the above-mentioned U.S. Pat. No. 4,394,581, is described a method for recording and reproducing a radiation image comprising the steps of (i) exposing a radiation image storage panel having a fluorescent layer composed of $BaFBr:Eu^{2+}$ phosphor (stimulable phosphor) and colored with Zapon Fast Blue 3G (organic blue colorant, manufactured by Hoechst AG.) to X-rays, (ii) scanning the panel with a He-Ne laser beam (633 nm), (iii) detecting the light emitted by the fluorescent layer of the panel by means of a photosensor to convert the light to an electrical signal, and (iv) converting the electrical signal to an image signal by means of a reproduction device to obtain an image on a display device. With particular reference to the above-mentioned method for recording and reproducing a radiation image, the lowering of the contrast of the reproduced image due to the light emission of the organic colorants caused by the stimulating rays will be described in detail hereinbelow.

As shown in FIG. 1, a radiation image storage panel 13 having a fluorescent layer composed of $BaFBr:Eu^{2+}$ phosphor and colored with Zapon Fast Blue 3G is exposed to X-rays emitted by an X-ray source 11 passing through an object 12, and thereafter, the panel 13 is scanned with a He-Ne laser beam emitted by a He-Ne laser source 14. By the stimulation with the He-Ne laser beam, the fluorescent layer of the panel 13 emits light. The light emitted by the fluorescent layer of the panel 13 is detected and converted to an electrical signal by a photosensor 15. Then, the electrical signal obtained is converted to an image signal by a reproduction device 16, and a visible image is displayed by a display device 17. In such a method for recording and reproducing a radiation image, a filter 18 is placed between the panel 13 and the photosensor 15. The filter 18 is used for cutting the noise constituted by the He-Ne laser beam reflected by the panel 13, thereby only transmitting the light emitted by the fluorescent layer of the panel 13. As shown in FIG. 2, the $BaFBr:Eu^{2+}$ phosphor constituting the fluorescent layer of the panel 13 has an emission spectrum in the near ultraviolet to green region (the emission spectrum has a peak in the neighborhood of 400 nm), and the wavelength of the He-Ne laser beam is 633 nm. Therefore, an ultraviolet to short wavelength visible light-transmitting filter which selectively transmits light of shorter wavelength than green light is employed as the filter 18. The ultraviolet to short wavelength visible light-transmitting filter transmits almost no long wavelength visible light, and accordingly, the He-Ne laser beam having a wavelength of 633 nm reflected by the panel 13 is completely cut by the filter. However, as illustrated by curve-a of FIG. 3 representing the spectral transmittance curve, all ultraviolet to short wavelength visible light-transmitting filters have high transmittance for infrared rays. On the other hand, as shown by curve-b of FIG. 3 representing the emission spectrum, Zapon Fast Blue 3G color the fluorescent layer of the panel 13 exhibits light emission in the red to infrared region when exposed to the He-Ne laser beam. Accordingly, as is clear from FIG. 3, when the panel 13 is exposed to the He-Ne laser beam, a part of the light emission (light emission in the infrared region) of Zapon Fast Blue 3G passes through the filter together with the light emission of the $BaFBr:Eu^{2+}$ phosphor. The light emission of the colorant passing through the filter is reproduced as a noise observed throughout the panel and as a result, the contrast of the image obtained is lowered.

SUMMARY OF THE INVENTION

The present invention relates to an improvement in the colored radiation image storage panel disclosed in the above-mentioned U.S. Pat. No. 4,394,581 which provides an image of high sharpness. In the present invention, as the colorant of the panel there is not used the organic colorants described in the U.S. Pat. No. 4,394,581 but an organic colorant which does not exhibit light emission of longer wavelength than that of the stimulating rays when exposed to the stimulating rays, thereby preventing the lowering of the contrast of the reproduced image due to the light emission of the colorant employed in the panel which occurs when the organic colorants described in the U.S. Pat. No. 4,394,581 are employed as the colorant. The above-mentioned organic colorant employed in the radiation image storage panel of the present invention that does not emit light of longer wavelength (lower energy) than that of the stimulating rays when exposed thereto is, in other words, as obvious from the Stoke's rule, an organic colorant which does not exhibit light emission at all when exposed to the stimulating rays.

The radiation image storage panel of the present invention has a fluorescent layer comprising a binder and a stimulable phosphor dispersed therein, and is colored with a colorant so that the mean reflectance of the panel in the wavelength region of the stimulating rays for the stimulable phosphor is lower than the mean reflectance of the panel in the wavelength region of the light emitted by the stimulable phosphor upon stimulation thereof characterized in that the colorant is an organic colorant which does not exhibit light emission of longer wavelength than that of the stimulating rays when exposed to the stimulating rays.

DETAILED DESCRIPTION OF THE INVENTION

Figure 1:
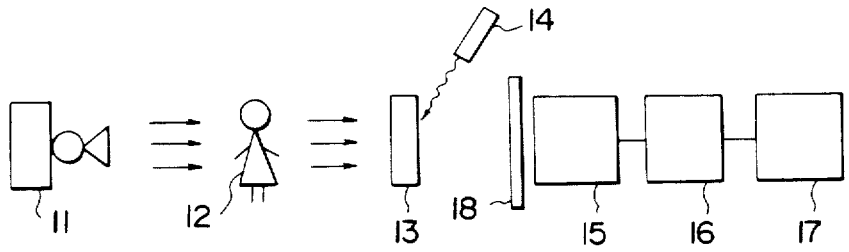
FIG. 1 schematically shows the method for recording and reproducing a radiation image using the radiation image storage panel of the present invention.
Figure 2:
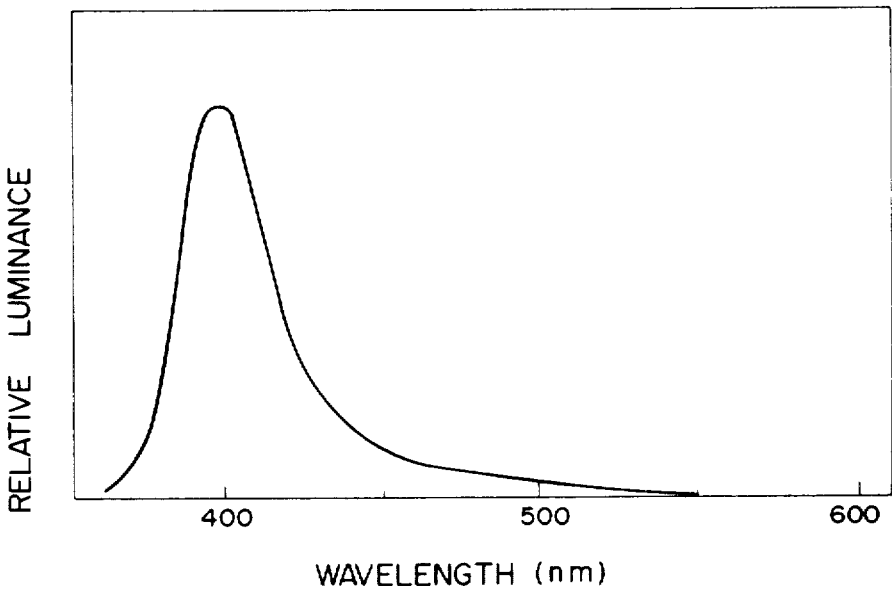
FIG. 2 is a graph showing the spectrum of the light emitted by the $BaFBr:Eu^{2+}$ phosphor upon stimulation thereof.

The present invention will be described in detail hereinbelow.

From the viewpoint of improvement of the sharpness of the radiation image storage panel, it is required for the organic colorant employed in the radiation image storage panel of the present invention to have the same stimulating ray absorption characteristics as those described in the above-mentioned U.S. Pat. No. 4,395,587. That is, it is required for the organic colorant employed in the radiation image storage panel of the present invention to have a low reflectance to the wavelength of the stimulating rays and to absorb the stimulating rays when the radiation image storage panel is exposed thereto. Because of the absorption of the stimulating rays by the colorant, the spread of the stimulating rays in the panel due to irradiation in the fluorescent layer, halation in the protective layer, the primer layer or the substrate, or the like is controlled. As a result, the sharpness of the image obtained is improved. On the other hand, from the viewpoint of the sensitivity of the radiation image storage panel, it is required for the organic colorant employed in the radiation image storage panel of the present invention to have as high reflectance as possible to the wavelength of the light emitted by the stimulable phosphor upon stimulation thereof. That is, it is required for the organic colorant to have as low absorbance as possible to the above wavelength and not to lower the sensitivity of the panel. Accordingly, from the viewpoint of both the sharpness and sensitivity of the radiation image storage panel, an organic colorant the reflectance of which to the wavelength of the stimulating rays is lower than the reflectance thereof to the wavelength of the light emitted by the stimulable phosphor upon stimulation thereof is employed in the radiation image storage panel of the present invention. More concretely, the organic colorant employed in the radiation image storage panel of the present invention has reflection characteristics that the mean reflectance thereof in the wavelength region of the stimulating rays for the stimulable phosphor employed in the panel is lower than the mean reflectance thereof in the wavelength region of the light emitted by the stimulable phosphor upon stimulation thereof. Accordingly, the radiation image storage panel of the present invention colored with such as organic colorant has reflection characteristics thaat the mean reflectance of the panel in the wavelength region of the stimulating rays or the stimulable phosphor employed in the panel is lower that the mean reflectance of the panel in the wavelength region of the light emitted by the stimulable phosphor upon stimulation thereof. From the viewpoint of improvement of the sharpness, the mean reflectance of the radiation image storage panel of the present invention in the wavelength region of the stimulating rays of the stimulable phosphor employed in the panel is desired to be as low as possible. Generally, the mean reflectance is preferably not higher than 95% of the mean reflectance of the uncolored equivalent in the same wavelength region. When the mean reflectance is higher than 95%, the sharpness of the panel is not sufficiently improved. On the other hand, from the viewpoint of sensitivity, the mean reflectance of the radiation image storage panel of the present invention in the wavelength region of the light emitted by the stimulable phosphor employed in the panel upon stimulation thereof is desired to be as high as possible. Generally, the mean reflectance is preferably not lower than 30%, more preferably not lower than 90% of the mean reflectance of the uncolored equivalent in the same wavelength region. The term "reflectance" as used herein means the reflectance measured by use of an integrating-sphere photometer.

In the radiation image storage panel of the present invention, any of the elements constituting the panel may be colored with an organic colorant. That is, it is possible to color the fluorescent layer, the substrate, the protective layer and/or the primer layer. Further, the panel may be colored by dividing the fluorescent layer into two layers and providing between the two layers an intermediate layer colored with an organic colorant (The intermediate layer does not contain a stimulable phosphor.). The constitution of the radiation image storage panel of the present invention can, for example, by any one of the following.

1. Radiation image storage panel consisting solely of a fluorescent layer which is self-supporting and is colored with an organic colorant. 2. Radiation image storage panel comprising a first protective layer, a self-supporting fluorescent layer disposed thereon and a second protective layer disposed further thereon in which at least one of layers is colored with an organic colorant.

3. Radiation image storage panel comprising a substrate and a fluorescent layer disposed thereon in which the substrate and/or the fluorescent layer is colored with an organic colorant.

4. Radiation image storage panel comprising a substrate, a primer layer disposed thereon, a fluorescent layer disposed further thereon in which at least one of the elements is colored with an organic colorant.

5. Radiation image storage panel comprising a substrate, a fluorescent layer disposed thereon and a protective layer disposed further thereon in which at least one of the elements is colored with an organic colorant.

6. Radiation image storage panel comprising a substrate, a primer layer disposed thereon, a fluorescent layer disposed further thereon and a protective layer disposed further thereon in which at least one of the elements is colored with an organic colorant.

7. Radiation image storage panel comprising a substrate, a first fluorescent layer disposed thereon, an intermediate layer disposed further thereon and a second fluorescent layer disposed further thereon in which at least the intermediate layer is colored with an organic colorant.

8. Radiation image storage panel comprising a substrate, a first fluorescent layer disposed thereon, an intermediate layer disposed further thereon, a second fluorescent layer disposed further thereon and a protective layer disposed further thereon in which at least the intermediate layer is colored with an organic colorant.

9. Radiation image storage panel comprising a substrate, a primer layer disposed thereon, a first fluorescent layer disposed further thereon, an intermediate layer disposed further thereon, a second fluorescent layer disposed further thereon and a protective layer disposed further thereon in which at least the intermediate layer is colored with an organic colorant.

In the radiation image storage panel of the present invention, the effect of the coloration depends upon which element or elements are colored. Generally, in order to prevent the occurrence of irradiation in the fluorescent layer, it is particularly effective to color the fluorescent layer or to provide the colored intermediate layer in the fluorescent layer. When the fluorescent layer is colored or the colored intermediate layer is provided in the fluorescent layer, the sharpness of the image obtained is improved particularly in the relatively high spatial frequency region. On the other hand, in order to prevent the occurrence of halation in the protective layer, the primer layer or the substrate, it is particularly effective to color the protective layer, the primer layer or the substrate. When the protective layer, the primer layer or the substrate is colored, the sharpness of the image obtained is improved particularly in the relatively low spatial frequency region. The resulting effect of the coloration depends upon which element or elements are colored as described above. For instance, in case of the radiation image storage panels in which only one element thereof is colored, the effect of the coloration of the panel can be generally ranked as follows depending upon which element is colored;

fluorescent layer > intermediate layer > primer layer or substrate > protective layer.

When the protective layer remote from the protective layer upon which the stimulating rays impinge is colored in the above-mentioned radiation image storage panel which comprises a first protective layer a fluorescent layer disposed thereon and a second protective layer disposed on the fluorescent layer, the effect of the coloration of the panel corresponds to that of a panel having a colored substrate.

When the fluorescent layer is colored, it is preferable that it be colored so that the degree of coloration gradually becomes higher from the side upon which the stimulating rays impinge to the opposite side. Of course, the radiation image storage panel colored in such a way provides an image of higher sharpness than the conventional uncolored radiation image storage panel. Further, when compared with a radiation image storage panel having the same sensitivity, it provides an image of higher sharpness than a radiation image storage panel having a fluorescent layer in which the degree of coloration has a gradient reverse to the above-mentioned gradient, or than a radiation image storage panel having a fluorescent layer homogeneously colored. As a method for forming a fluorescent layer having the above-mentioned gradient in degree of coloration, there can, for example, be employed a method wherein several fluorescent layers having slightly different degrees of coloration from each other are laminated in the order of degree of coloration, or a method utilizing the diffusion or the movement of the colorant contained in a coating dispersion which takes place when the coating dispersion is dried very slowly after application thereof to form a fluorescent layer. When the fluorescent layer contains an intermediate layer, that is, when the fluorescent layer is divided into two layers and an intermediate layer is provided between the two layers as described above, the above-mentioned "gradient of degree of coloration" means the gradient of degree of coloration in the part of the fluorescent layer other than the intermediate layer.

When the fluorescent layer is colored so that the degree of coloration gradually becomes higher from the stimulating ray impinging side to the opposite side as described above, it is preferable that the fluorescent layer have a gradient of degree of coloration such that the mean reflectance of the fluorescent layer in the wavelength region of the stimulating rays for the stimulable phosphor measured from the side opposite to the stimulating ray impinging side is not higher than 95% of that measured from the stimulating ray impinging side. When the former is higher than 95% of the latter, the effect of causing the fluorescent layer to have the gradient of degree of coloration is very small. The surface of the fluorescent layer having the lower degree of coloration, that is, the stimulating ray impinging side of the fluorescent layer need not necessarily be colored.

As described above, differently from the organic colorants described in the above-mentioned U.S. Pat. No. 4,394,581, the organic colorant employed in the radiation image storage panel of the present invention is an organic colorant which does not exhibit light emission of longer wavelength than that of the stimulating rays when exposed to the stimulating rays, that is, an organic colorant which does not exhibit light emission at all when exposed to the stimulating rays. By employing such an organic colorant, it is possible to prevent the lowering of the contrast of the reproduced image due to the light emission of the colorant employed in the panel caused by the stimulating rays which occurs when the organic colorants described in the above-mentioned U.S. Pat. No. 4,394,581 are employed as the colorant. As an example of organic colorants which do not exhibit light emission at all when exposed to the stimulating rays, metallic complex salt colorants can be mentioned. Further, as described above, the organic colorant employed in the radiation image storage panel of the present invention has reflection characteristics such that the mean reflectance thereof in the wavelength region of the stimulating rays for the stimulable phosphor employed in the panel is lower than the mean reflectance thereof in the wavelength region of the light emitted by the stimulable phosphor upon stimulation thereof. Therefore, the organic colorant employed in the panel depends upon the kind of stimulable phosphor employed therein. As described hereinbelow, from the viewpoint of practical use, the stimulable phosphor employed in the radiation image storage panel of the present invention should preferably be a phosphor which emits light having a wavelength ranging from 300 to 600 nm when exposed to stimulating rays having a wavelength ranging from 500 to 800 nm. In combination with such a stimulable phosphor, an organic colorant having a body color ranging from blue to green is employed so that the mean reflectance of the panel in the wavelength region of the stimulating rays for the stimulable phosphor may be lowered down to below the mean reflectance of the panel in the wavelength region of the light emitted by the stimulable phosphor upon stimulation thereof, and so that the difference therebetween may be enlarged.

The organic metallic complex salt colorant employed in the radiation image storage panel of the present invention which has a body color ranging from blue to green and does no exhibit light emission at all when exposed to stimulating rays is selected from metal complex salt dyes such as phthalocyanine dyes and azo dyes. In particular, dyes with color index numbers 24411, 23160, 74180, 74200, 22800, 23150, 23155, 24401, 14880, 15050, 15706, 15707, 17941, 74220, 13425, 13361, 13420, 11836, 74140, 74380, 74350 and 74460 are preferably employed in the radiation image storage panel of the present invention.

As mentioned above, the stimulable phosphor which can be employed in the radiation image storage panel of the present invention is a phosphor which emits light when exposed to stimulating rays after exposure to a radiation. From the viewpoint of practical use, the stimulable phosphor should preferably be a phosphor which emits light having a wavelength ranging from 300 to 600 nm when exposed to stimulating rays having a wavelength ranging from 500 to 800 nm. For example, the stimulable phosphor which can be employed in the radiation image storage panel of the present invention includes (a) SrS:Ce,Sm, SrS:Eu,Sm, $La_2O_2S$:Eu,Sm and (Zn,Cd)S:Mn,X wherein X is halogen, which are described in the above-mentioned U.S. Pat. No. 3,859,527; (b) ZnS:Cu,Pb, $BaO.xAl_2O_3$:Eu wherein x is a number satisfying the condition of $0.8 \leqq x \leqq 10$, and $M^{II}O.xSiO_2$:A wherein $M^{II}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, which are described in U.S. Pat. No. 4,236,078; (c) $(Ba_{1-x-y},Mg_x,Ca_y)FX:aEu^{2+}$ wherein X is Cl and/or Br, x and y are numbers satisfying the conditions of $0<x+y \leqq 0.6$ and $xy \neq 0$, and a is a number satisfying the condition of $10^{-6} \leqq a \leqq 5 \times 10^{-2}$, which is described in U.S. patent application Ser. No. 57,080; (d) LnOX:xA wherein Ln is at least one element selected from the group consisting of La, Y, Gd and Lu, X is Cl and/or Br, A is Ce and/or Tb, and x is a number satisfying the condition of $0<x<0.1$, which is described in U.S. Pat. No. 4,236,078; (e) $(Ba_{1-x},M^{II}_x)FX:yA$ wherein $M^{II}$ is at least on divalent metal selected from the group consisting of Mg, Ca, Sr, Zn and Cd, X is at least one halogen selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, which is described in U.S. Pat. No. 4,239,968; and the like. However, needless to say, the stimulable phosphor which can be employed in the present invention is not limited to the above-mentioned phosphors, and any phosphor can be employed in the present invention provided that the phosphor emits light when exposed to stimulating rays after exposure to a radiation.

In general, there is a tendency for the granularity of a radiation image storage panel to become higher and the sensitivity thereof to become lower as the mean particle size of the stimulable phosphor employed therein becomes smaller. To the contrary, there is a tendency for the sensitivity of the radiation image storage panel to become higher and the granularity thereof to become lower as the mean particle size of the stimulable phosphor employed therein becomes larger. In consideration of these tendencies, the stimulable phosphor employed in the present invention is generally selected from those having a mean particle size ranging from 0.1 to 100μ. A stimulable phosphor having a mean particle size ranging from 1 to 30μ is preferably employed. Further, the amount of the stimulable phosphor employed is properly decided in view of the recording and reproducing performance of the radiation image storage panel and of economic considerations. The amount of the stimulable phosphor is generally within the range of 3 to 300 mg per 1 $cm^2$ of the radiation image storage panel.

The fluorescent layer of the radiation image storage panel of the present invention is formed by dispersing the stimulable phosphor (in a case wherein the fluorescent layer is not to be colored) or the stimulable phosphor and the colorant (in a case wherein the fluorescent layer is to be colored, when the fluorescent layer is self-supporting and the radiation image storage panel consists solely thereof, the fluorescent layer is of course always colored) in a proper binder to prepare a coating dispersion, and then applying the coating dispersion by a conventional coating method to form a uniform layer. The coating dispersion for forming the colored fluorescent layer may be prepared either by dispersing the stimulable phosphor and the colorant separately in the binder or by causing the colorant to adhere to the surface of the stimulable phosphor beforehand, and then dispersing the resulting mixture in the binder. When a colored fluorescent layer having the above-mentioned gradient of degree of coloration is desired, such a fluorescent layer can be formed, for example, by a method wherein several coating dispersions having slightly different colorant contents (that is, slightly different degrees of coloration) are applied and laminated in the order of degree of coloration to form a fluorescent layer, or by a method utilizing the diffusion or the movement of the colorant contained in a coating dispersion which takes place when the coating dispersion is dried very slowly after application thereof. As the binder, there can be used one commonly used in forming a layer such as gum arabic, protein such as gelatin, polysaccharide such as dextran, polyvinyl butyral, polyvinyl acetate, nitrocellulose, ethylcellulose, vinylidene chloride-vinylchloride copolymer, polymethyl methacrylate, vinylchloride-vinylacetate copolymer, polyurethane, cellulose acetate butyrate, polyvinyl alcohol, or the like. The binder is generally used in an amount of 0.01 to 1 part by weight per one part by weight of the stimulable phosphor. However, from the viewpoint of the sensitivity and the sharpness of the panel obtained, the amount of the binder should preferably be small. Accordingly, in consideration of both the sensitivity and the sharpness of the panel and the easiness of application of the coating dispersion, the binder is preferably used in an amount of 0.03 to 0.2 parts by weight per one part by weight of the stimulable phosphor. The thickness of the fluorescent layer (In the radiation image storage panel in which the fluorescent layer is divided into two layers and a colored intermediate layer is provided therebetween, the total thickness of the three layers corresponds to this thickness.) is generally within the range of 10μ to 1 mm.

In the radiation image storage panel of the present invention, a substrate for supporting the fluorescent layer is generally used. As the substrate, various materials such as polymer material, glass, wool, cotton, paper, metal, or the like can be used. From the viewpoint of handling the panel as an information recording medium, the substrate should preferably be processed into a sheet or a roll having flexibility. In this connection, the substrate is preferably of plastic film such as cellulose acetate film, polyester film, polyethylene terephthalate film, polyamide film, polyimide film, triacetate film, polycarbonate film, or the like; ordinary paper; and processed paper such as photographic paper, printing paper such as coated paper and art paper, baryta paper, resin-coated paper, sized paper described in Belgian Pat. No. 784,615 which is sized with polysaccharide, pigment-containing paper which contains a pigment such as titanium dioxide, sized paper which is sized with polyvinyl alcohol, or the like. The substrate may have a primer layer on one surface thereof (the surface on which the fluorescent layer is provided) for the purpose of holding the fluorescent layer tightly. As the material of the primer layer, an ordinary adhesive is employed. In providing a fluorescent layer on the substrate, a coating dispersion comprising a stimulable phosphor dispersed in a binder, or a coating dispersion comprising a stimulable phosphor and a colorant dispersed in a binder may be directly applied to the substrate to form a fluorescent layer. Alternatively, a fluorescent layer formed beforehand may be bonded to the substrate. Where the substrate used is permeable to stimulating rays, the radiation image storage panel can be exposed to stimulating rays from the substrate side.

When the substrate is colored with a colorant, the substrate should naturally be colored so that the stimulating rays arriving at the substrate are absorbed by the colorant. For example, when the material used as the substrate is one which is not permeable to stimulating rays such as metal, ordinary paper, processed paper, or the like, at least the fluorescent layer side surface of the substrate should be colored. On the other hand, when the material used as the substrate is one which is permeable to stimulating rays such as glass, plastic film, or the like, either surface of the substrate may be colored, or both surfaces thereof may be colored, or the whole substrate may be colored. One surface or both the surfaces of the substrate are colored, for example, by applying thereon a coating dispersion comprising a binder and a colorant dispersed therein. The whole substrate is generally colored by dispersing a colorant in the substrate when the substrate is manufactured. Further, when the primer layer is colored with a colorant, the colorant is dispersed therein.

In the radiation image storage panel of the present invention, when an intermediate layer (not containing a stimulable phosphor) is provided between two fluorescent layers, the intermediate layer should always be colored with a colorant. When the intermediate layer is not colored with a colorant, it does not improve but adversely affects the image characteristics of the panel. It seems that similarly to the case wherein the fluorescent layer is colored, the disposition of the colored intermediate layer is particularly effective in preventing the occurrence of irradiation in the two fluorescent layers provided on opposite sides of the colored intermediate layer. The colored intermediate layer comprises a binder of the same type as that employed in the fluorescent layer, and a colorant dispersed therein. The colored intermediate layer may be provided between two fluorescent layers by applying a coating dispersion comprising a colorant dispersed in a proper binder to a first fluorescent layer formed beforehand, and then, forming a second fluorescent layer on the colored intermediate layer. Alternatively, the colored intermediate layer may be provided between the fluorescent layers by bonding the colored intermediate layer to a first fluorescent layer, and then, bonding a second fluorescent layer to the colored intermediate layer.

Further, in the radiation image storage panel of the present invention, a protective layer for physically and chemically protecting the surface of the fluorescent layer is generally provided on the surface of the fluorescent layer to be exposed (the side opposite the substrate). As mentioned above, when the fluorescent layer is self-supporting, the protective layer may be provided on both surfaces of the fluorescent layer. The protective layer may be provided on the fluorescent layer by directly applying thereto a coating dispersion to form the protective layer thereon, or may be provided thereon by bonding thereto a protective layer formed beforehand. As the material of the protective layer, a conventional material for a protective layer such as nitrocellulose, ethylcellulose, cellulose acetate, polyester, polyethylene terephthalate, or the like can be used.

When the protective layer is colored with a colorant, either surface thereof may be colored, or both surfaces thereof may be colored, or the whole protective layer may be colored. Generally, the whole protective layer is homogeneously colored by dispersing therein a colorant.

The radiation image storage panel of the present invention provides an image of high sharpness and contrast when used in the method for recording and reproducing a radiation image shown in FIG. 1. In this method, a radiation source 11 such as an X-ray source, an object 12, a radiation image storage panel 13 of the present invention colored with an organic colorant which does not exhibit light emission at all when exposed to stimulating rays, a light source 14 emitting stimulating rays which stimulate the fluorescent layer of the panel 13 to release the radiation energy stored therein as fluorescent light, a photosensor 15 for detecting the fluorescent light emitted by the panel 13, a reproduction device 16 for converting an electrical signal obtained from the photosensor 15 to an image signal corresponding to the radiation image, a display device 17 for displaying the image, and a filter 18 for cutting the stimulating rays emitted by the light source 14 and reflected by the panel 13 and for transmitting only the fluorescent light emitted by the panel 13 are arranged as shown in FIG. 1. In the method shown in FIG. 1, the photosensor 15 is used as a detector for detecting the light emitted by the panel 13, and reproduction of a radiation image is performed by means of the photosensor 15, the reproduction device 16 and the display device 17. However, means for reproducing a radiation image is not limited thereto.

As shown in FIG. 1, the object 12 is positioned between the radiation source 11 and the radiation image storage panel 13. When the object 12 is exposed to a radiation from the source 11, the radiation passes through the object 12. The intensity of the radiation which has passed through the object 12 represents the transmittance of the object 12. Therefore, an image which represents the pattern of transmittance of the object 12 is obtained from the radiation impinging upon the radiation image storage panel 13. The radiation in the form of the image representing the pattern of transmittance of the object 12 is absorbed by the fluorescent layer of the panel 13, and electrons or holes are generated in the fluorescent layer. The amount the electrons or holes generated is in proportion to the amount of the radiation absorbed. The electrons or holes are stored at the trap level of the stimulable phosphor, and thus, the radiation image is stored in the panel 13.

Then, the radiation image stored in the panel 13 is visualized by stimulation with the stimulating rays emitted by the light source 14. That is, the fluorescent layer of the panel 13 is scanned with the stimulating rays emitted by the light source 14, whereby the electrons or holes stored at the trap level of the stimulable phosphor are expelled therefrom, and the radiation image stored in the panel 13 is released as fluorescent light. The panel 13 is colored with an organic colorant which selectively absorbs the stimulating rays, and therefore, when the fluorescent layer is scanned with the stimulating rays, the spread of the stimulating rays in the panel 13 due to irradiation in the fluorescent layer, halation in the protective layer, the primer layer or the substrate, or the like is controlled by the absorption of the stimulating rays by the colorant. Further, panel 13 is colored with an organic colorant which does not exhibit light emission when exposed to the stimulating rays, and therefore, light other than the fluorescent light emitted by the stimulable phosphor is not emitted by the fluorescent layer of the panel 13 when the fluorescent layer is scanned. The luminance of the fluorescent light emitted by the panel 13 is in proportion to the number of the electrons or holes stored in the fluorescent layer of the panel 13, that is, the amount of the radiation absorbed thereby. The fluorescent light (light signal) is detected and converted to an electrical signal sequentially by the photosensor 15 which is, for example, a photomultiplier. The electrical signal obtained is converted to an image signal corresponding to the radiation image by the reproduction device 16, and a visible image is displayed by the display device 17. Thus, the radiation image is reproduced.

As mentioned above, in the radiation image storage panel of the present invention, the spread of the stimulating rays in the panel is controlled by the absorption of the stimulating rays by the organic colorant contained in the panel. Therefore, the sharpness of the image reproduced by the reproduction device 16 and accordingly the sharpness of the image displayed by the display device 17 is markedly improved.

Further, differently from the organic colorants described in the above-mentioned U.S. Pat. No. 4,394,581, when exposed to stimulating rays, the organic colorant employed in the radiation image storage panel of the present invention does not exhibit light emission which is reproduced as a noise. Therefore, the contrast of the image reproduced by the reproduction device 16 and accordingly the contrast of the image displayed by the display device 17 is higher than the contrast of the image obtained by the radiation image storage panel colored with the organic colorants described in the U.S. Pat. No. 4,394,581.

As described hereinabove, the present invention relates to an improvement in the contrast of the colored radiation image storage panel disclosed in the U.S. Pat. No. 4,394,581 which provides an image of high sharpness. That is, in the present invention, an organic colorant which does not exhibit light emission when exposed to stimulating rays is employed as the colorant of the panel, thereby is prevented the lowering of the contrast of the reproduced image due to the light emission of the colorant employed in the panel which occurs when the organic colorants described in the U.S. Pat. No. 4,394,581 are employed as the colorant. When compared with a radiation image storage panel which provide an image of the same sharpness, the radiation image storage panel of the present invention provides an image of higher contrast than the radiation image storage panel colored with the organic colorants described in the U.S. Pat. No. 4,394,581. Among the radiation image storage panels of the present invention, the radiation image storage panel having its fluorescent layer colored so that the degree of coloration gradually becomes higher from the stimulating ray impinging side to the opposite side provides an image of higher sharpness than the others.

The present invention will hereinbelow be described referring to the examples 1 and 2.

EXAMPLE 1

8 parts by weight of $BaFBr:Eu^{2+}$ phosphor (stimulable phosphor) and one part by weight of nitrocellulose (binder) were mixed by use of a solvent (a mixture of acetone, ethyl acetate and butyl acetate) to prepare a coating dispersion having a viscosity of 50 centistokes. Separately, a dispersion comprising methanol and Vali Fast Blue 1605 (organic metallic complex salt blue colorant, manufactured by Orient Co., Ltd.) dispersed therein was prepared. Then, the dispersion was added to the coating dispersion in such a ratio that the amount of the colorant was 1 milligram per 100 grams of the $BaFBr:Eu^{2+}$ phosphor. Thereafter, the coating dispersion containing the colorant was uniformly applied to a polyethylene terephthalate film (substrate) positioned horizontally and dried naturally by allowing it to stand for a day to form a fluorescent layer of a thickness of about 300μ. The radiation image storage panel thus obtained was designated "Panel A".

On the other hand, two radiation image storage panels (Panel B and Panel C) were manufactured for comparison with Panel A in the same manner as mentioned above except for adding Zapon Fast Blue 3G (organic blue colorant, manufactured by Hoechst AG.) instead of Vali Fast Blue 1605 to the coating dispersion in the same ratio as mentioned above and in the same manner as mentioned above except for not adding Vali Fast Blue 1605 to the coating dispersion, respectively.

Then, Panel A, Panel B and Panel C were exposed to X-rays of 80 KVp and 250 mA emitted by an X-ray source located at a distance of 180 cm from the panels for 50 milliseconds, and thereafter, the panels were scanned with a He-Ne laser beam (633 nm). The light emitted by the fluorescent layer of the panels was caused to pass through a Corning 5-56 filter (manufactured by Corning Glass Works), and the light passing through the filter was detected and converted to an electrical signal by a photosensor (a photomultiplier having a spectral sensitivity of type S-5). The electrical signal obtained was converted to an image signal by a reproduction device, and a visible image was diplsyed by a display device. The modulation transfer function (MTF) of the image was obtained for Panel A, Panel B and Panel C. The MTF values of Panel A, Panel B and Panel C at a spatial frequency of 2 cycles/mm were 49%, 46% and 18%, respectively, when the MTF values of those panels at a spatial frequency of zero cycle/mm were defined to be 100%. It should be noted that the MTF value of the respective images obtained for Panel A, Panel B and Panel C and the relationship therebetween do not depend upon what type of reproduction device and display device are used.

As is clear from the above the MTF values, Panel A and Panel B colored with a colorant provide a markedly sharper image than Panel C which is not colored with a colorant.

Then, the contrast of the image was measured for Panel A and Panel B. The measurement of the contrast was performed by covering half of the panel being tested with a lead plate of a thickness of 2 mm, reproducing a radiation image in the same manner as mentioned above using the panel and then, obtaining the difference between the density of the portion of the image reproduced by the portion of the panel covered with the lead plate and the density of the portion of the image reproduced by the portion of the panel not covered with the lead plate. The difference in density in the image obtained from Panel A was 2.00. On the other hand, the difference in density in the image obtained from Panel B was 1.00.

As is clear from the above differences in density, Panel A of the present invention colored with Vali Fast Blue 1605 provides an image of markedly higher contrast than Panel B colored with Zapon Fast Blue 3G. The reason for the fact that Panel A provides an image of markedly higher contrast than Panel B is as follows.

Figure 3:
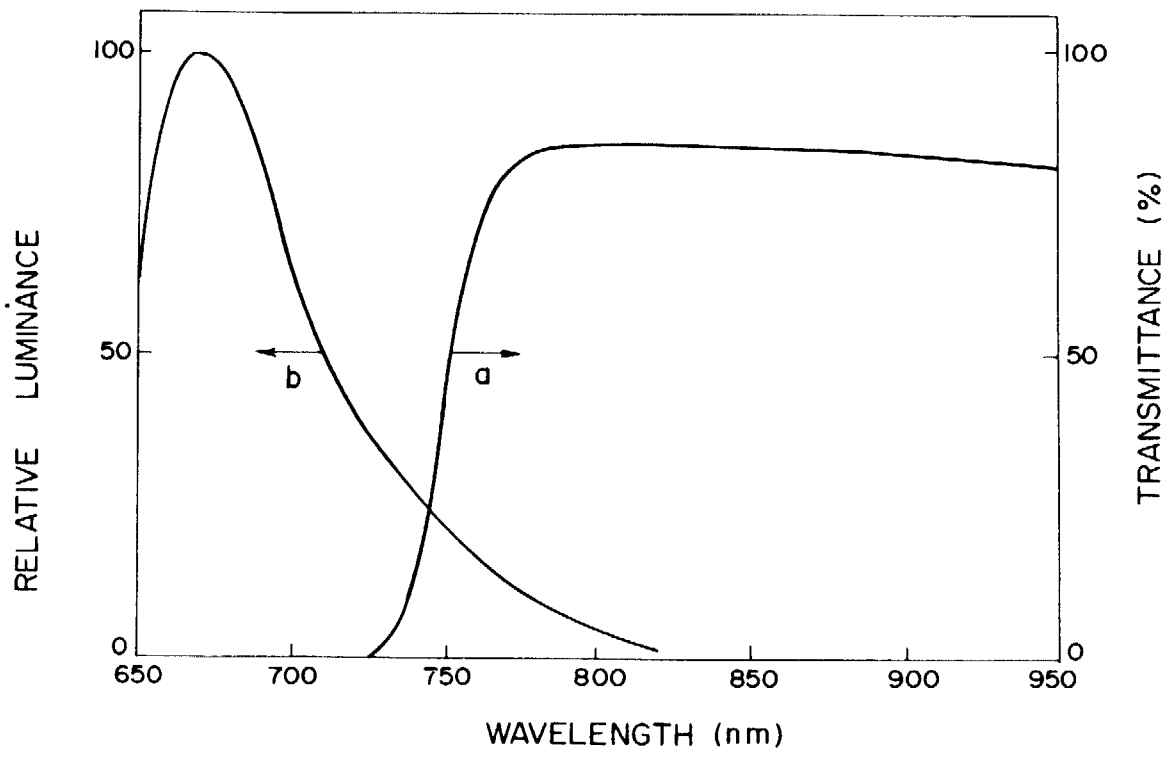
FIG. 3 is a graph showing the spectral transmittance curve in the red to infrared region of Corning 5-56 filter (curve-a) and the spectrum of the light emitted by Zapon Fast Blue 3G (organic blue colorant) when the colorant is exposed to a He-Ne laser beam (curve-b).

Zapon Fast Blue 3G employed in Panel B exhibits light emission in the red to infrared region when exposed to the He-Ne laser beam (The emission spectrum of Zapon Fast Blue 3G is shown by curve-b in FIG. 3.), and a part of the light emission (light emission in the infrared region) passes through Corning 5-56 filter (The spectral transmittance curve in the red to infrared region of the filter is shown by curve-a in FIG. 3) and is reproduced as noise observed throughout the panel. Contrary to this, Vali Fast Blue 1605 employed in Panel A does not exhibit light emission at all when exposed to the He-Ne laser beam. Moreover, it is worth nothing that the amount of the light emitted by Panel B and detected by the photosensor was 1.4 times as large as the amount of the light emitted by Panel A and detected by the photosensor. This is because in Panel B, the light emitted by Zapon Fast Blue 3G is added to the light emitted by the $BaFBr:Eu^{2+}$ phosphor.

EXAMPLE 2

A radiation image storage panel was manufactured in the same manner as mentioned in Example 1 except for using Cupro Cyanine Blue GL (organic metallic complex salt blue colorant, manufactured by Toyo Ink Co., Ltd.) instead of Vali Fast Blue 1605 in such ratio that the amount of the colorant was 1 milligram per 100 grams of the $BaFBr:Eu^{2+}$ phosphor. The radiation image storage panel thus obtained was designated "Panel D".

On the other hand, another radiation image storage panel was manufactured for comparison with Panel D in the same manner as mentioned in Example 1 except for using Oil Blue No. 603 (organic blue colorant, manufactured by Orient Co., Ltd.) instead of Vali Fast Blue 1605 in such ratio that the amount of the colorant was 1 milligram per 100 grams of the $BaFBr:Eu^{2+}$ phosphor. The radiation image storage panel thus obtained was designated "Panel E".

Then, the MTFs of both Panel D and Panel E were measured in the same manner as mentioned in Example 1. The MTF values of Panel D and Panel E at a spatial frequency of 2 cycles/mm were 49% and 50%, respectively, when the MTF values of the panels at a spatial frequency of zero cycle/mm were defined to be 100%. As is clear from the MTF values, the sharpness of the image provided by Panel D of the present invention is almost the same as that of the image provided by Panel E.

Further, the above-mentioned difference in density in the two images reproduced by Panel D and Panel E was obtained in the same manner as mentioned in Example 1. The difference in density in the image obtained from Panel D was 2.00. On the other hand, the difference in density in the image obtained from Panel E was 0.90. As is clear from the differences in density, Panel D of the present invention colored with Cupro Cyanine Blue GL provides an image of markedly high contrast than Panel E colored with Oil Blue No. 603. The reason for the fact that Panel D provides an image of markedly high contrast than Panel E is the same as explained in Example 1. That is, Oil Blue No. 603 employed in Panel E exhibits light emission when exposed to the He-Ne laser beam, and a part of the light emission passes through the Corning 5-56 filter and is reproduced as a noise. Contrary to this, Cupro Cyanine Blue GL does not exhibit light emission at all when exposed to the He-Ne laser beam. The amount of the light emitted by Panel E and detected by the photosensor was 1.45 times as large as the amount of the light emitted by Panel D and detected by the photosensor.

I claim:

1. A radiation image storage panel having a fluorescent layer comprising a binder and a stimulable phosphor dispersed therein, and being colored with a colorant so that the mean reflectance of said panel in the wavelength region of the stimulating rays for said stimulable phosphor is lower than the mean reflectance of said panel in the wavelength region of the light emitted by said stimulable phosphor upon stimulation thereof characterized in that said colorant is an organic colorant which does not exhibit light emission of longer wavelength than that of said stimulating rays when exposed to said stimulating rays.

2. A radiation image storage panel as defined in claim 1 wherein the mean reflectance of said panel in the wavelength region of said stimulating rays is not higher than 95% of the mean reflectance of a panel equivalent to said panel except for being uncolored with said organic colorant in the wavelength region of said stimulating rays.

3. A radiation image storage panel as defined in claim 1 wherein the mean reflectance of said panel in the wavelength region of said light is not lower than 30% of the mean reflectance of a panel equivalent to said panel except for being uncolored with said organic colorant in the wavelength region of said light.

4. A radiation image storage panel as defined in claim 3 wherein said mean reflectance of said panel as not lower than 90% of the mean reflectance of said equivalent panel.

5. A radiation image storage panel is defined in claim 1 wherein at least said fluorescent layer is colored with said organic colorant so that the degree of coloration gradually becomes higher from the side upon which said stimulating rays impinge to the opposite side.

6. A radiation image storage panel as defined in claim 5 wherein the mean reflectance of said fluorescent layer in the wavelength region of said stimulating rays measured from said opposite side is not higher than 95% of the mean reflectance of said fluorescent layer in the wavelength region of said stimulating rays measured from said stimulating ray impinging side.

7. A radiation image storage panel as defined in claim 1 wherein said panel consists solely of said fluorescent layer, said fluorescent layer being colored with said organic colorant.

8. A radiation image storage panel as defined in claim 1 wherein said panel comprises a first protective layer, a fluorescent layer disposed thereon and a second protective layer disposed further thereon, and at least one of said layers is colored with said organic colorant.

9. A radiation image storage panel as defined in claim 1 wherein said panel comprises a substrate and a fluorescent layer disposed thereon, and said substrate and/or said fluorescent layer is colored with said organic colorant.

10. A radiation image storage panel as defined in claim 1 wherein said panel comprises a substrate, a primer layer disposed thereon and a fluorescent layer disposed further thereon, and at least one of said substrate and said layers is colored with said organic colorant.

11. A radiation image storage panel as defined in claim 1 wherein said panel comprises a substrate, a fluorescent layer disposed thereon and a protective layer disposed further thereon, and at least one of said substrate and said layers is colored with said organic colorant.

12. A radiation image storage panel as defined in claim 1 wherein said panel comprises a substrate, a primer layer disposed thereon, a fluorescent layer disposed further thereon and a protective layer disposed further thereon, and at least one of said substrate and said layers is colored with said organic colorant.

13. A radiation image storage panel as defined in claim 1 wherein said panel comprises a substrate, a first fluorescent layer disposed thereon, an intermediate layer disposed further thereon and a second fluorescent layer disposed further thereon, and at least said intermediate layer is colored with said organic colorant.

14. A radiation image storage panel as defined in claim 1 wherein said panel comprises a substrate, a first fluorescent layer disposed thereon, an intermediate layer disposed further thereon, a second fluorescent layer disposed further thereon and a protective layer disposed further thereon, and at least said intermediate layer is colored with said organic colorant.

15. A radiation image storage panel as defined in claim 1 wherein said panel comprises a substrate, a primer layer disposed thereon, a first fluorescent layer disposed further thereon, an intermediate layer disposed further thereon, a second fluorescent layer disposed further thereon and a protective layer disposed further thereon, and at least said intermediate layer is colored with said organic colorant.

16. A radiation image storage panel as defined in claim 1 wherein said organic colorant is an organic metallic complex salt colorant.

* * * * *